US005102119A

United States Patent [19]

Gerlach

[11] Patent Number: 5,102,119

[45] Date of Patent: * Apr. 7, 1992

[54] EXERCISE HOOP

[76] Inventor: Michael J. Gerlach, 21133 Stonecrop Pl., Ashburn, Va. 22011

[ * ] Notice: The portion of the term of this patent subsequent to Feb. 20, 2007 has been disclaimed.

[21] Appl. No.: 476,801

[22] Filed: Feb. 8, 1990

Related U.S. Application Data

[63] Continuation-in-part of Ser. No. 250,172, Sep. 28, 1988, Pat. No. 4,902,004.

[51] Int. Cl.[5] ..... A63B 25/08

[52] U.S. Cl. ..... 482/77; 482/908

[58] Field of Search ..... 272/70.1, 70, 99, 135, 272/138, 139, 100, 101, 65, 66, 115, 141, 114, 109; 267/158, 160, 162

[56] References Cited

U.S. PATENT DOCUMENTS 4,902,004 2/1990 Gerlach ..... 272/114

*Primary Examiner*—Richard J. Apley
*Assistant Examiner*—Jerome Donnelly
*Attorney, Agent, or Firm*—Finnegan, Henderson Farabow, Garrett and Dunner

[57] ABSTRACT

An exercise device using a fiber reinforced plastic matrix hoop as a resilient member with telescoping rigid members each connected at respective diametrically opposed locations on the hoop. A handle and foot support are coupled to one of the telescoping members. Elongated weight adjusting members having a length greater than the diameter of the hoop may be fastened at opposite ends to the diametrically opposed locations for incremently increasing the weight range of the device. Another embodiment using fiber reinforced plastic bow springs as the resilient members are fastened to opposite ends of the telescoping rigid members. The resilient member may or may not be used with the bow springs.

28 Claims, 11 Drawing Sheets

FIG. 18
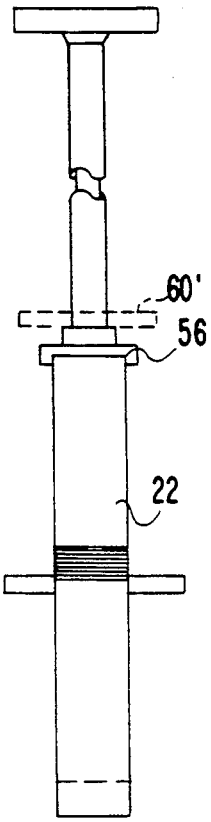
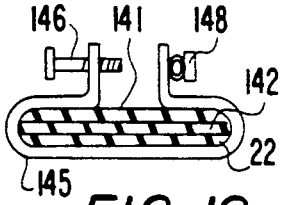
FIG. 19
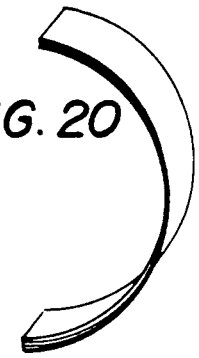
FIG. 20
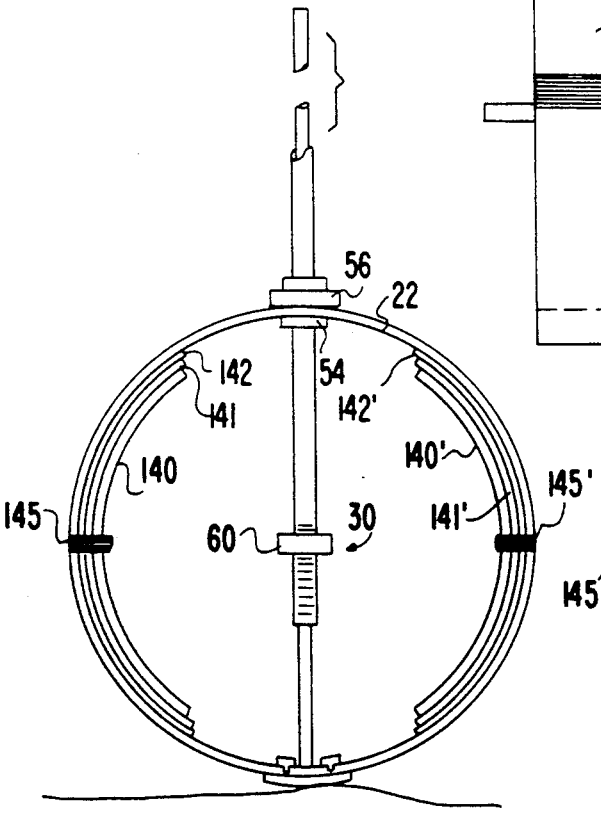
FIG. 16
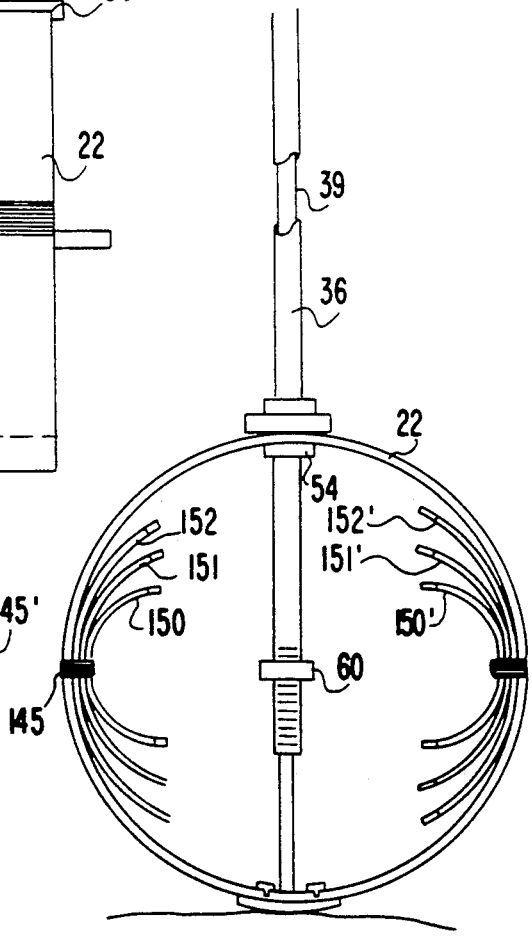
FIG. 17

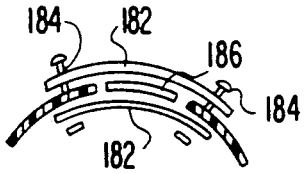
FIG. 27
FIG. 28
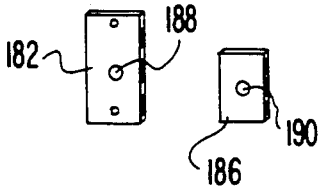
FIG. 29
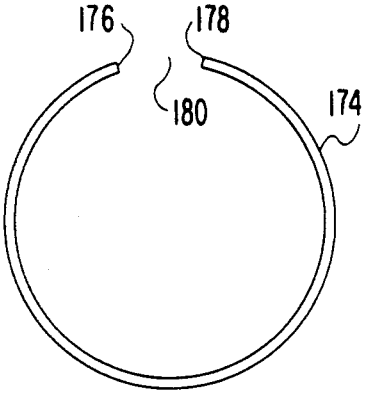
FIG. 26
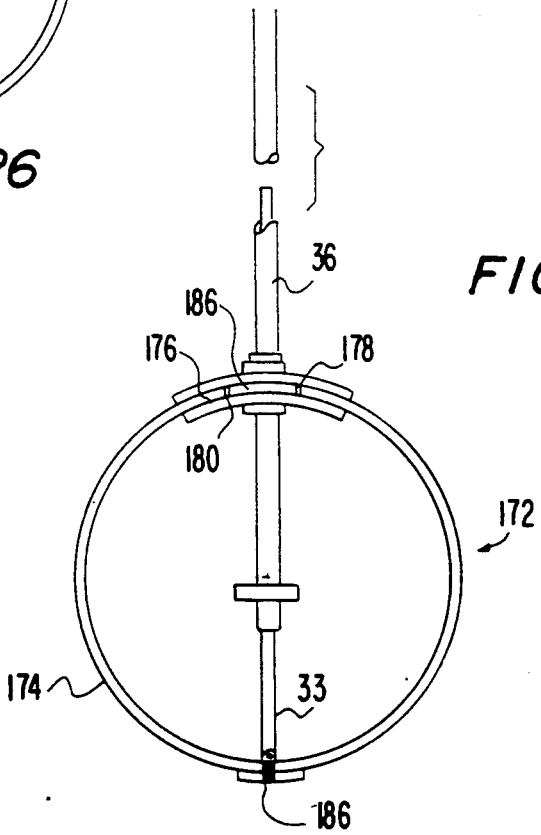
FIG. 25

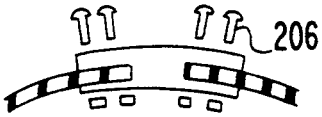
FIG. 33
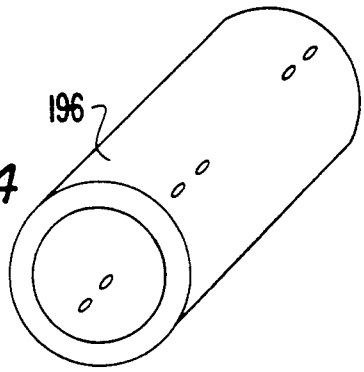
FIG. 34
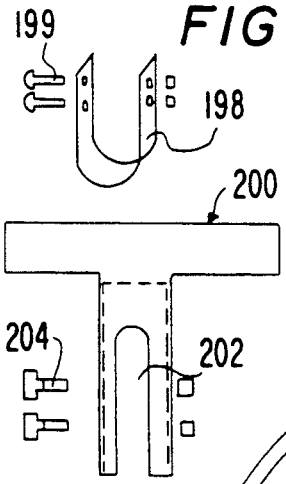
FIG. 32
FIG. 31
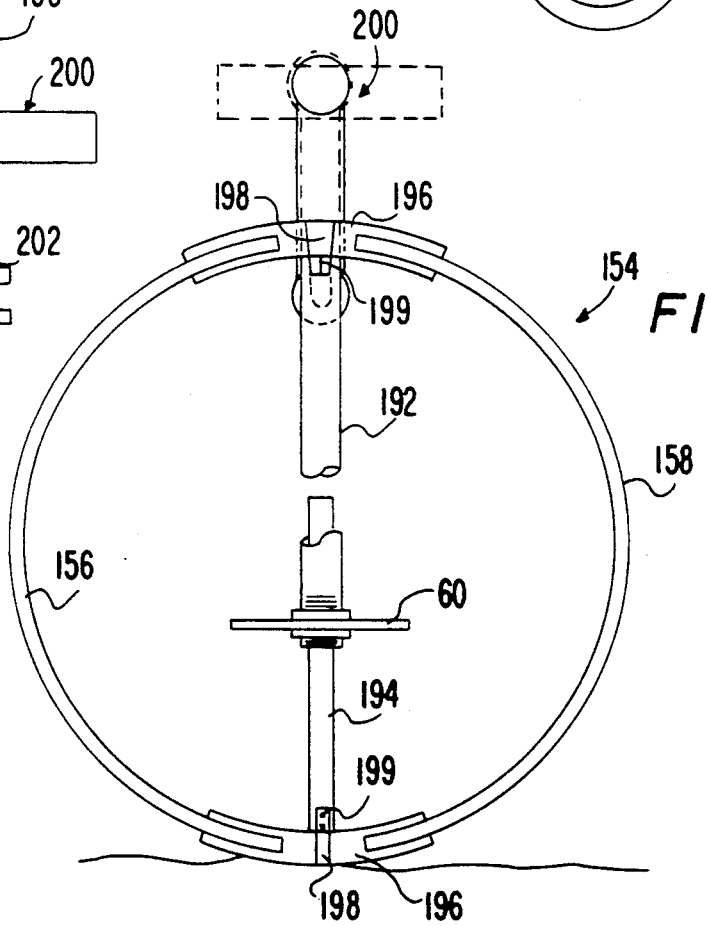
FIG. 30

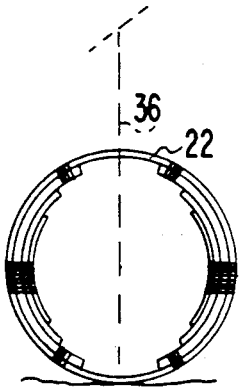
FIG. 46a
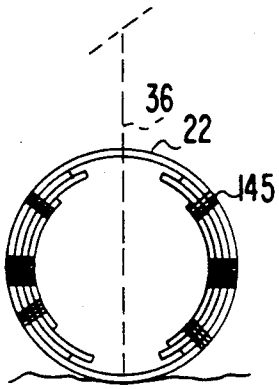
FIG. 46b
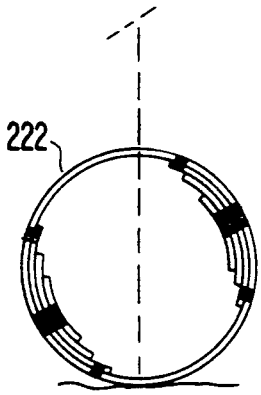
FIG. 46c
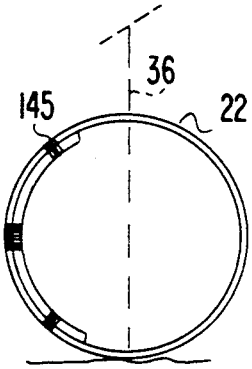
FIG. 46d
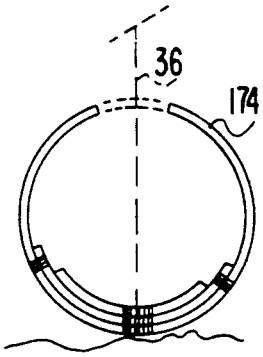
FIG. 46e
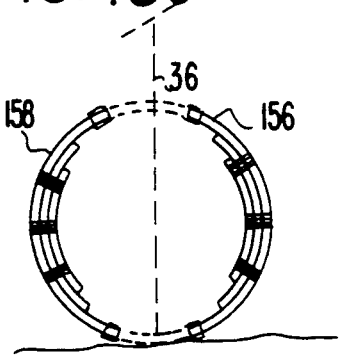
FIG. 46f
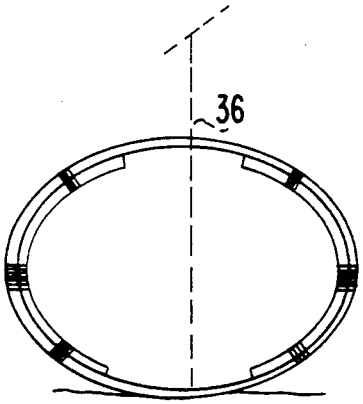
FIG. 46g
FIG. 46h
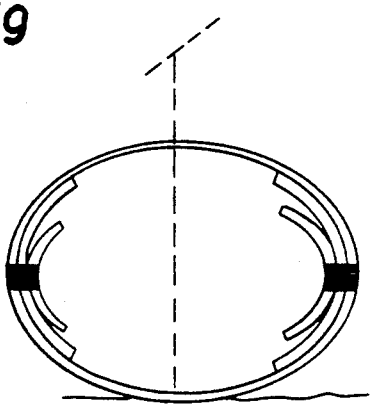

EXERCISE HOOP

BACKGROUND OF THE INVENTION

This is a continuation-in-part of U.S. patent application Ser. No. 07/250,172 filed Sept. 28, 1988, now U.S. Pat. No. 4,902,004, the entire disclosure of which is relied upon and incorporated by reference herein.

FIELD OF THE INVENTION

The present invention relates to a recreational exercise device; and more particularly to an exercise device of the type where user locomotion is effected by bouncing.

DISCUSSION OF RELATED ART

An exercise device of the type known as a pogo stick has been known for many years. Pogo sticks appear to offer fun and enjoyment to users of all ages, as well as provide beneficial exercise. They are relatively safe to use, even for young children. However, they have never gained the widespread popularity, either as recreational or exercise devices, as did the spring type hobby horses for the very young children, or the trampoline for older children and adults. Some of the lack of this widespread popularity can be attributed to the inherent jolting action or skeletal shock that the user suffers just prior to the users weight overcoming the friction and stiffness of the confined coil spring as the base of the pogo stick strikes the ground. The limitations of the confined spring and friction cause the conventional pogo stick to provide a bouncing action similar to the short hops of a rabbit. A good deal of effort is required in order to effect even these short hops, which detracts substantially from the fulfillment associated with being propelled upwardly and forwardly by the spring action.

Another disadvantage that limits pogo-stick popularity is the required utility surface. By its very nature, the conventional pogo-stick must be used on a concrete, asphalt or hardwood surface in order to effect any bouncing action whatsoever. This, of course, limits the areas of use and makes them quite impracticable for playground or backyard use.

Of course another characteristic of conventional pogo-sticks is their difficulty of manufacture. Except for the very young children, the resistance to shock and needed strength of the various parts inordinately increases the cost of manufacturing. Also, the pogo stick must be sized accurately for each user weight range.

Various proposals have been offered in an attempt to overcome some of the above limitations. For example, in an attempt to overcome some of the deficiencies of coil springs, a pogo stick was proposed having a telescoping piston and cylinder arrangement incorporating an air spring. The air pressure in the cylinder is varied depending on the weight of the user. Also, other types of spring action, such as rubber balls, have been proposed. In an attempt to provide a device that would operate on lawns or other penetrable surfaces, a plurality of radially spaced spring legs were used to support the device. The above devices appear to be satisfactory for the purposes intended; however, in many instances, disadvantages were overcome at the expense of other features. For example, the device having the air spring was relatively complicated and expensive to manufacture. The multi-legged device occupied a relatively large area, and tended to be unstable when more weight was exerted on certain of the spring legs than other.

Additionally, the above mentioned examples, with the possible exception of the air spring, must be individually sized for the various weight ranges of the user.

SUMMARY OF THE INVENTION

One of the objects of the present invention is to provide an improved exercise device that overcomes the deficiencies and limitations of a conventional pogo-stick.

Another object of the present invention is to provide an improved exercise device that minimizes skeletal shock and provides a smooth bouncing action more like a kangaroo than a rabbit.

A further object of the present invention is to provide an improved bouncing type exercise device that can be effectively used on utility surfaces other than concrete or the like.

A further object of the present invention is to provide an improved bouncing type exercise device that is user adjustable to be variably spring loaded for different weights and spring action.

Still another object of the present invention is to provide an improved exercise device of the pogo-stick type that exhibits minimal friction between moving parts.

A still further object of the present invention is to provide an improved exorcise device of the pogo-stick type that is simple in construction, relatively easy to manufacture, and reliable and stable in operation.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, the exercise device of the present invention comprises a annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user. The annular spring means may be a pair of arcuate segments with opposite ends connected to form the annulus. Elongate means having inner and outer end portions at opposite ends of a longitudinal axis thereof; the elongate means being fixedly mounted at the inner end portion thereof to the annulus at a first location and slidably mounted intermediate the inner and outer end portions thereof adjacent a second location diametrically opposed to the first location. The mounting of the elongate means to the diametrically opposed first and second locations maintains substantial symmetry of flexure of the annulus in response to a compressive and recovery first of the annulus in the direction of the longitudinal axis of the elongate means; a user support having a foot supporting surface disposed for supporting the weight of a user at times when the annular member is upright and engaging the utility surface at the first location, said support being mounted to move with the portion of the annulus adjacent the second location and relative to the annulus portion adjacent the first location; and a handle mounted on the elongate means adjacent the outer end portion thereof and having a portion adapted to be grasped by a user standing on the foot supporting surface.

In another aspect, the exercise device of the present invention comprises annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user; an elongate means having inner and outer end portions at opposite ends of a longitudinal axis thereof; the elongate means being fixedly mounted to the annulus at a first location; a user support having a foot supporting surface disposed for supporting the weight of a user at times when the annular member is upright and engaging the utility surface at a second location, said support being mounted to move with the portion of the annulus adjacent the first location and relative to the annulus portion adjacent the second location; a handle mounted on the elongate means adjacent the outer end portion thereof and having a portion adapted to be grasped by a user standing on the foot supporting surface; and weight adjusting means removably coupled to the annular spring means adjacent the first and second locations for resisting compression of the annulus for supporting a user having a second weight range greater than the first named weight range.

In one aspect, the non-metallic resilient spring means is preferably a continuous annulus of a fiber reinforced plastic matrix.

In another aspect, the resilient spring means is a pair of arcuate spring segments connected at opposite ends.

In another aspect the resilient spring means is preferable an annulus comprised of a single arcuate member of less than 360° with opposite ends joined by a connecting member.

In still another aspect, the weight adjusting means is comprised of one or more arcuate spring segments removably attached to the inner surface of the annulus and capable of being placed in practically any selected angular position for varying the weight and spring action of the annular resilient spring means.

The accompanying drawings which are incorporated in and constitute a part of this specification illustrate several embodiments of the invention and, together with the description serve to explain the principles of the invention.

DESCRIPTION OF THE DRAWINGS

FIG. 16 is a front elevational view of an exercise device in accordance with the seventh embodiment of the present invention illustrating arcuate piggy-backed spring segments attached to the inner surface of the annular spring means;

FIG. 17 is a front elevational view of an exercise device in accordance with an eighth embodiment of the present invention illustrating piggy-backed arcuate segments having a radius less than the radius of the hoop;

FIG. 18 is an elevational side view of the seventh and eighth embodiments;

FIG. 19 is a cross-sectional view of a clamp for removably attaching the arcuate segments to the inner surface of the annular spring;

FIG. 20 is a perspective view of an individual non-metallic arcuate segment used in the embodiments of FIGS. 16 and 17;

FIG. 25 is a fragmentary front elevation of an exercise device in accordance with a tenth embodiment of the present invention;

FIG. 26 is a front view of an arcuate segment used in the embodiment of FIG. 25;

FIG. 27 is a fragmentary sectional view illustrating the manner of connecting opposite ends of the arcuate spring of the device of FIG. 25;

FIG. 28 and FIG. 29 are members for connecting the elongate member to diametrically opposite locations of the annular spring of the embodiment of FIG. 25;

FIG. 30 is a front elevational view of an exercise device in accordance with an eleventh embodiment of the present invention;

FIG. 31 is an end view illustrating a removable handle for the exercise device of FIG. 30;

FIG. 32 illustrates the bracket used in connecting the hoop assembly to the elongate member when the optional handle of FIG. 31 is not used;

FIG. 33 is a fragmentary sectional view for showing the manner in which opposite ends of the arcuate segments of FIG. 30 are connected;

FIG. 34 illustrates in perspective the member for connecting the segments of the device of FIG. 30;

FIG. 46(*a*) through (*h*) illustrate various arrangements for connecting the user adjustable multi-variable load bearing rebound arcuate spring segments for various annular spring assemblies.

DESCRIPTION OF THE PREFERRED EMBODIMENTS

Figure 1:
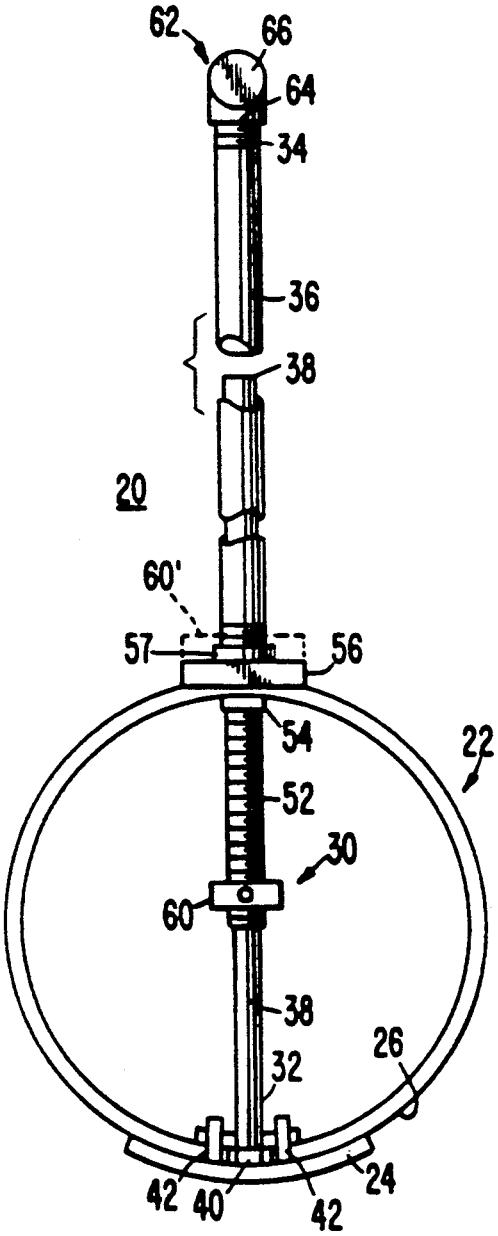
FIG. 1 is a side elevational view of an exercise device in accordance with a first embodiment of the invention.

Reference will now be made in detail to the present preferred embodiments of the invention, examples of which are illustrated in the accompanying drawings wherein like reference numerals refer to like parts throughout the drawings.

Figure 2:
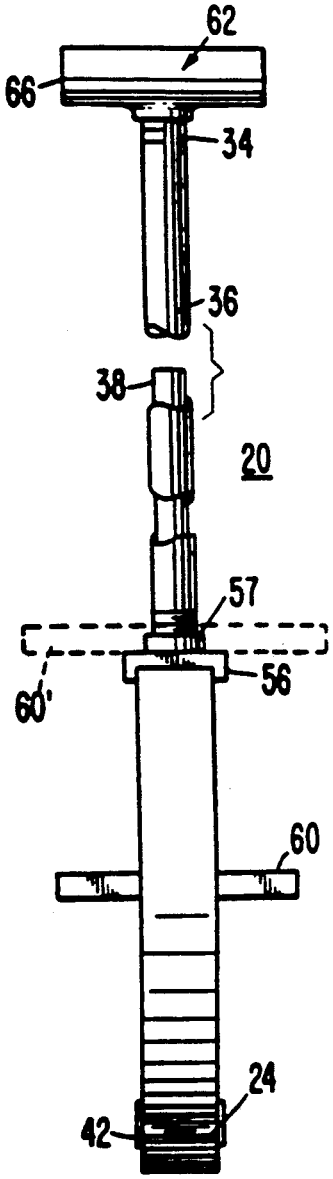
FIG. 2 is a front elevational view of the exercise device of FIG. 1.

Referring to FIGS. 1 and 2, an exercise device for bouncing a user carried by the device from a utility surface according to one embodiment of the invention is generally referred to at 20. In accordance with the invention, the exercise device 20 comprises annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user. As embodied herein, a circular non-metallic hoop base 22 constitutes the annular resilient spring means. Hoop 22 may have a rubberized tread strip 24 attached, such as by gluing, for example, to an exterior surface 26 of the hoop to aid in preventing slipping or skidding of the device on a utility surface such as 26, during use.

Hoop 22 is made of a polymer composite, such as a fiber reinforced plastic matrix of a selected diameter, thickness, and width. The fiber may be composed of fiberglass, aramid, carbon, or graphite; and the plastic matrix may be of the thermosetting type or the thermoplastic type. If of the thermosetting type the plastic matrix may be selected from the group including epoxy, polyester, vinylester, phenolic, and polyurethane. If of the thermoplastic type, the matrix may be of the group including ABS, PVC, acrylic, polyamide, polycarbonate, thermoplastic polyester, polyethylene, polystyrene and polysulfone. Preferably, the fiber is fiberglass and the plastic matrix is epoxy or vinylester. To facilitate manufacture, hoop 22 may be made n a mandrel in the same manner as tough fiber reinforced plastic conduit for power and communication lines; and then sliced to the desired widths. In one actual reduction to practice hoop 22 is approximately thirteen inches in diameter, three inches in width, one-eight of an inch thick, and made of fiberglass and epoxy. Although, a device of this size could accommodate a user over a substantially larger weight range, with less satisfying results, satisfactory bounce or rebound may be attained by children in a weight range of from forty to seventy pounds. In another actual reduction to practice, member 22 was approximately eighteen inches in diameter, one-fifth of an inch thick, two inches in width. A child that weighed fifty pounds was able to bounce so that total vertical movement of the child was in the neighborhood of from two and one-half to three feet. A slight forward leaning or "body english" resulted in a forward movement of from two and one-half to four feet. Further, the child was able to effect a three hundred sixty degree spin while the device was out of contact with the utility surface.

In accordance with the invention, elongate means having inner and outer end portions at opposite ends of a longitudinal axis thereof are fixedly mounted at the inner end portion thereof to the annulus at a first location and slidably mounted intermediate the inner and outer end portions thereof adjacent a second location diametrically opposed to the first location.

Figure 3:
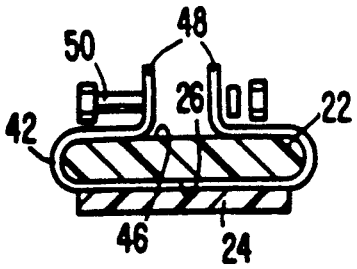
FIG. 3 is an enlarged sectional view taken on line 3—3 to illustrate a clamp component used in the present invention.
Figure 4:
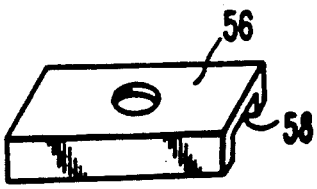
FIG. 4 is an enlarged view of a channel plate that is used in several embodiments of the invention.

As herein embodied, and referring again to FIGS. 1 and 2, the elongate means is an assembly generally referred to as 30 having an inner end portion 32 and an outer end portion 34. Assembly 30 is preferably a first length of thick walled plastic pipe 36 or other suitable material, telescopically mounted to slidably fit over a second length of pipe or rod 38, which may be made of plastic or other suitable material. The outer diameter of pipe 38 and the inner diameter of pipe 36 are dimensioned so that pipe 36 and 38 slide easily relative to one another longitudinally with minimal lateral tolerance. Pipe 38 is securely fastened at inner end portion 32 to a relatively thick rectangular shaped piece of polymer 40, such as nylon, for example. Piece 40, preferably, has a width dimension corresponding to the width dimension of annular 22, and a length dimension sufficient to accommodate clamps 42 on opposite sides of pipe 38. If rod 38 is solid, polymer piece 40 may be fastened thereto by a screw 44 inserted through the piece and threaded axially into rod 38. If it is hollow, a flanged fitting may be fastened to pipe 38, with the flanges being riveted or screwed to piece 40. Piece 40 is then in turn clamped to inner peripheral surface 46 by clamps 42 on opposite sides of rod 38. Referring to FIG. 3, clamp 42 may be a flexible piece of metal or plastic that has a configuration substantially corresponding to annulus 22 in cross section with integral tabs 48 that are drawn together by a nut and bolt assembly 50. Length of pipe 36 has a machine threaded portion 58 adjacent the end from which rod 38 extends. Pipe 36 extends through a hole drilled or otherwise formed in annulus 22 which is diametrically opposite the location on the annulus where inner end 32 of rod 38 is attached. A bushing or sleeve 54 is threadably positioned on threaded portion 52 to longitudinally position pipe 36 relative to rod 38 within the annulus. A channel bar 56 having a channel width corresponding to the width of the annulus may be either threadably or slidably positioned on pipe 36 for fitting engagement with annulus 22 on outer surface 26 thereof. An internally threaded sleeve 57 threaded on pipe 36 in engagement with channel bar 56 tightly secures annulus 22 against surface 58 of the channel of channel bar 56 to complete the installation. The mounting of the elongate means to the diametrically opposed first and second locations maintains substantial symmetry of flexure of the annulus in response to a compressive and recovery force of the annulus in the direction of the longitudinal axis of the elongate means.

The present invention includes a user support having a foot supporting surface disposed for supporting the weight of a user at times when the annular member is upright and engaging the utility surface at the first location, said support being mounted to move with the portion of the annulus adjacent the second location and move relative to the annulus portion adjacent the first location.

As embodied herein and referring again to FIGS. 1 and 2, a foot support 60 for supporting the weight of a user, may be a channel bar similar to channel bar 56 provided it has a length substantially wider than the width of annulus 22. Foot support 60 is threadably fastened to threaded portion 52 of pipe 36 and is preferably adjustable along the length thereof to accommodate the requirements of individual users. Foot support 60 may be either positioned along pipe 36 within the periphery of the annulus, or outside the periphery as shown by foot support 60 in dashed lines of FIGS. 1 and 2. For minimizing the number of different parts in the device, if channel bar 56 slidably fits on pipe 36, foot support 60 or 60' can be secured in position with internally threaded sleeves, for example. Also, for economy of manufacture, channel bar 56 could also be configured to have sufficient length and a threaded upper surface to serve as a foot support as well as a support for mounting pipe 36 to annulus 22.

The invention also includes a handle mounted on the elongate means adjacent the outer end portion thereof and having a portion adapted to be grasped by a user standing on the foot supporting surface. As herein embodied, a handle 62 has an internally threaded neck portion 64 which is threaded on outer end 34 of pipe 36. Handle 62 has a portion 64 that extends perpendicular to the axis of assembly 30 which is adapted to be grasped by a user supported on foot support 60.

Figure 5:
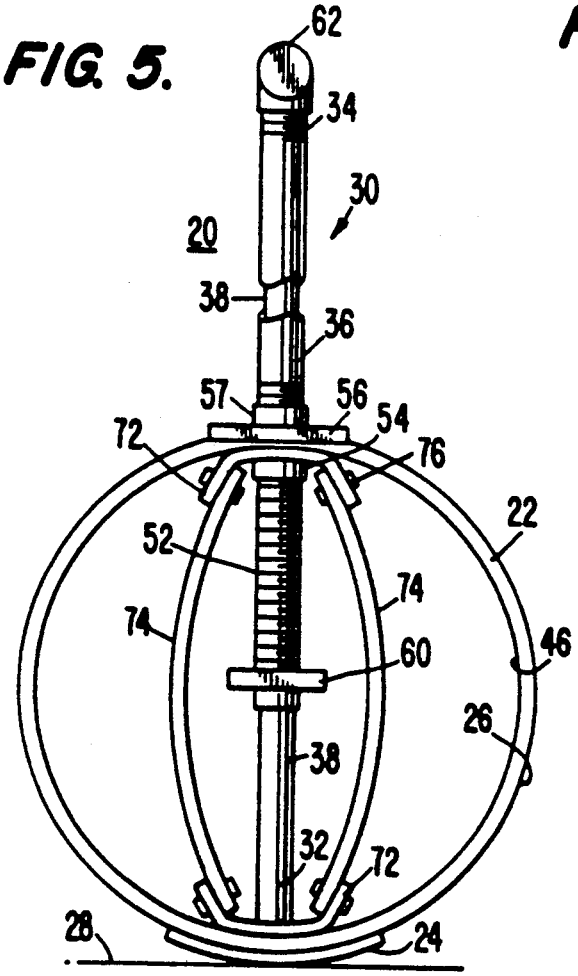
FIG. 5 is a side elevational view of an exercise device in accordance with a second embodiment of the present invention.
Figure 6:
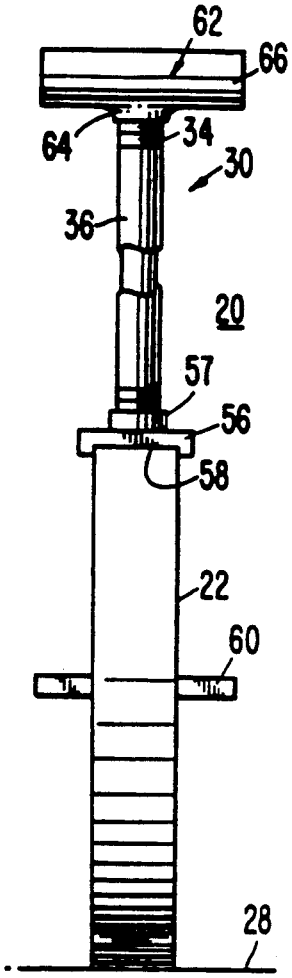
FIG. 6 is a front elevational view of the exercise device of FIG. 5.
Figure 7:
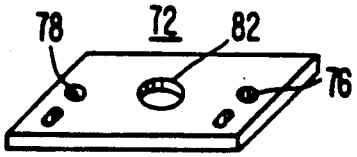
FIG. 7 is an enlarged view of a plastic hinge for removably securing the weight adjusting bars to the device of FIG. 5 and 6.
Figure 8:
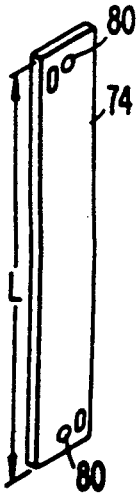
FIG. 8 is a view of the weight adjusting bar of FIG. 5 prior to installation.
Figure 9:
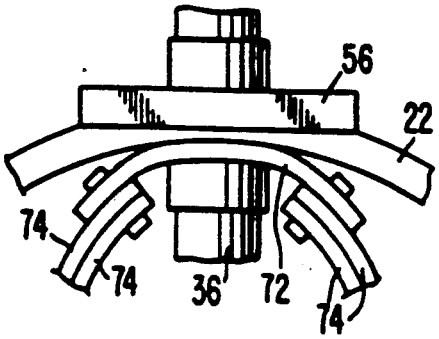
FIG. 9 is an enlarged fragmentary view of the assembly of the weight adjusting bars of FIG. 5.
Figure 15:
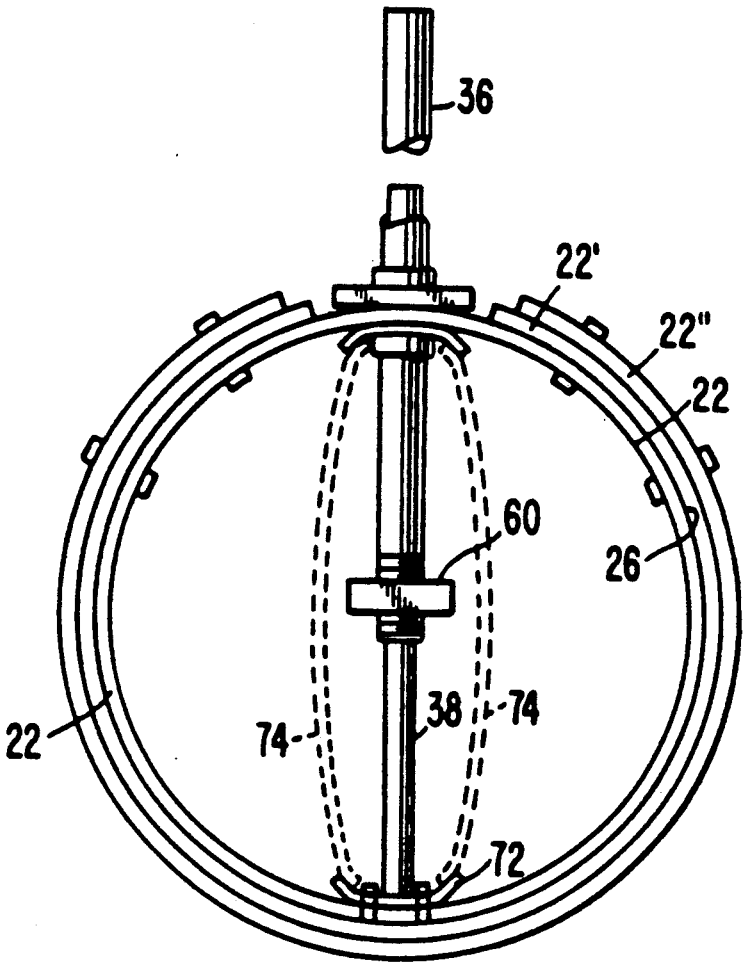
FIG. 15 is an elevational view of a hoop used in the present invention with piggy-backed arcuate spring hoop segments attached to the outer surface in accordance with a sixth embodiment of the invention.

In accordance with another embodiment of the present invention, the exercise device further comprises weight adjusting means removably coupled to the annular spring means adjacent the first and second locations for resisting compression of the annulus for supporting a user having a second weight range greater than the first named weight range. As embodied herein and referring to FIGS. 5 and 6, exercise device 70 is similar in all respects to exercise device 20 of FIGS. 1 and 2, except that rectangular strips 72, made of a polymer, such as nylon, may either replace, as illustrated, rectangular piece 40, or if desired, be used in addition thereto at the first location on the annulus. Also, a second rectangular strip 72 is fastened to the annulus at the second location between sleeve 54 and the inner surface 46 of annulus 22. Members 72 are used as supports or hinges for the weight adjusting means, which in the present preferred embodiments constitute elongated resilient members 74 having a length L greater than the diameter of annulus 22 with opposite ends thereof mounted to the annulus by attachment to rectangular strips 72. To removably fasten the members 74 in position within the periphery of the annulus, the members are forcibly bowed slightly as illustrated in FIG. 5. Similarly, each of the hinge members 72 are bent inwardly away from inner surface 46 of the periphery of annulus 22, and attached by threaded nuts and bolts 76 extending through holes 76 and 80, respectively. Pipe 36 extends through hole 82. Thus, when assembled, the weight adjusting means includes a pair of elongated arcuate resilient members 74, each having opposite ends removably coupled to annulus 22 adjacent the first and second locations diametrically opposite each other, the pair of arcuate members 74 being disposed opposing each other in alignment with the plane of annulus 22. Members 74 are preferably the same width as the width of annular member 22 and have a thickness corresponding to the desired increments of weight range adjustment. As shown in FIG. 9, more than one pair of members 74 can be removably attached to hinge members 72. The weight adjusting members 74 are made of fiber reinforced plastic matrix similar to the annulus 22, and are preferably made in long strips, which are cut to length depending on the diameter of the annulus in which they are to be used. For a device where the elongated weight adjusting members are installed, rod or pipe 38 may be omitted therefrom because members 74 provide additional support that increases the stability and tendency of the annulus to maintain alignment without warping during use. Referring to FIG. 15, and in accordance with the present invention, as arcuate segment such as 22' may be fastened in a piggy-back manner on outer surface 26 of hoop 22 to increase the weight capacity of the device. Also, one or more additional segments, such as 22" may be piggy-backed on segment 22'. Such segments may be used with or without weight adjuster members 74. In one actual reduction to practice, member 22 was one-fifth of an inch thick, two inches wide and approximately 18 inches in diameter had one segment 22' of the same thickness and width fastened to outer surface 26 of hoop 22 in conjunction with two pair of weight adjuster members as described in connection with FIGS. 5 and 6 of the same thickness and width. This device was able to be used in a very satisfactory manner by an adult weighing 210 pounds.

Figure 10:
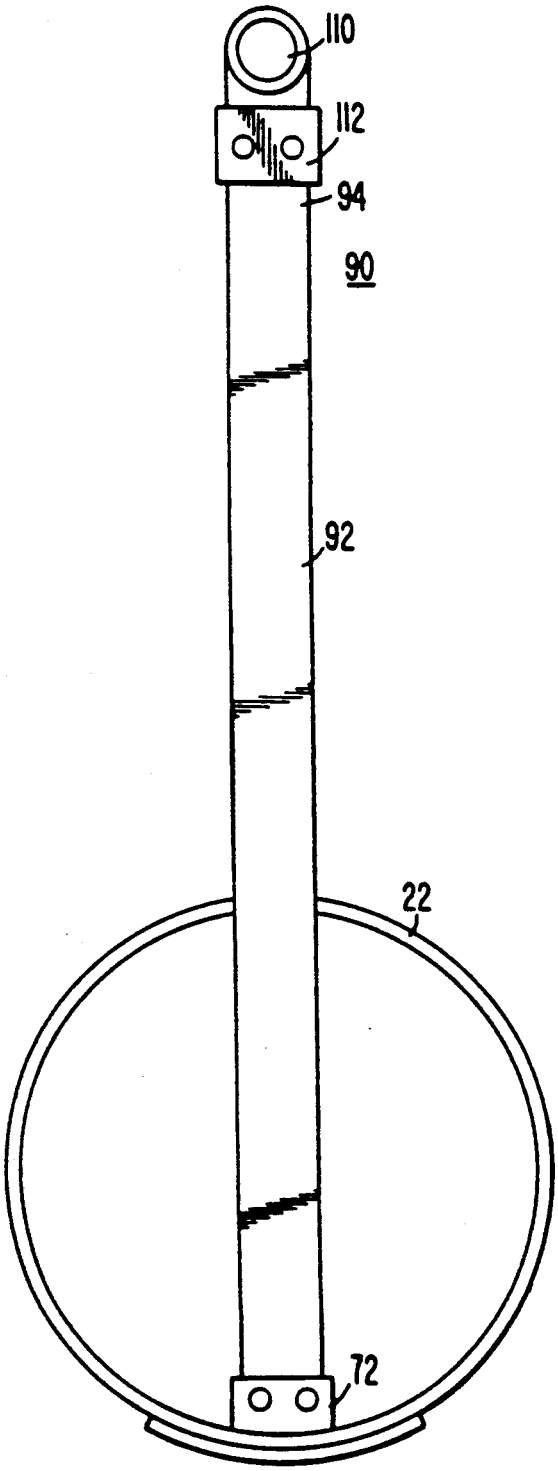
FIG. 10 is a side elevational view of an exercise device in accordance with a third embodiment of the present invention.
Figure 11:
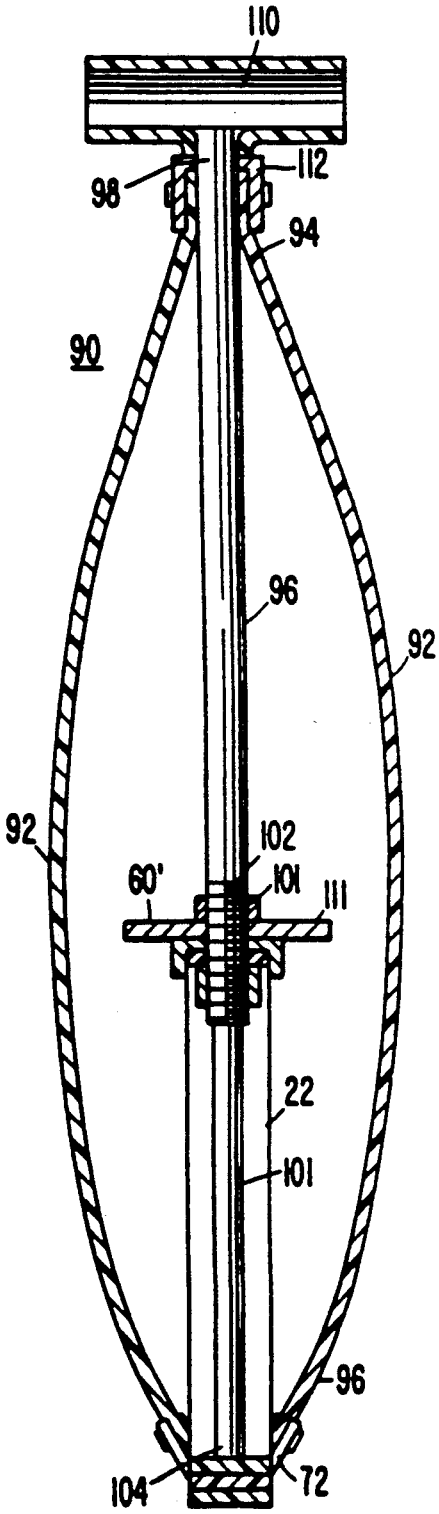
FIG. 11 is a sectional view along line 11—11 of FIG. 10.

In accordance with a third embodiment of the invention, the exercise device, comprises a pair of oppositely disposed resilient arcuate spring segments each terminating at first and second opposite end portions and lying in substantially the same plane. As embodied herein and referring to FIGS. 10 and 11, an exercise device generally referred to as 90 has a pair of arcuate resilient spring segments 92 which terminate at first and second opposite end portions 94 and 96, respectively. Spring segments 92 are preferably made from the same material described in connecting with annular member 22 and weight adjuster member 72 discussed in connection with the previously described embodiments. Spring members are preferably approximately three inches wide, one-eighth to one quarter of an inch thick, have a length of anywhere from two to five feet depending on the size of the user.

The invention includes a first substantially rigid elongated member 96 having inner and outer end portions 98 and 100, member 96 is fixedly attached adjacent outer end portion 98 to the first end portion 94 of each spring segment 92 and extends longitudinally along a line substantially corresponding to the common chord of each segment 92. The invention further includes a second substantially rigid elongated member 101 having an inner end portion 102 telescopically mounted to inner end portion 100 of first elongated member 96 for sliding relative the first member longitudinally and having an outer end portion 104 fixedly attached adjacent second end portion 96 of spring segments 92. Relative sliding motion of first and second elongated members 96 and 101 is operative to flex opposing spring segments 92 for storing and releasing energy. A user support 60' is mounted on member 96 intermediate the first and second opposite end portions 94 and 96 of spring segments 92. The support has a foot supporting surface extending in the plane of the oppositely disposed spring segments for supporting the weight of a user. Foot support 60' may be similar to foot support 60 previously described. Members 96 and 101 may be similar to members 36 and 38. A handle 110 is mounted on elongated member 96 adjacent outer end portion 98 and has a portion extending substantially parallel to foot support 60' that is adapted to be grasped by a user standing on the foot supporting surface. Exercise device 90 preferably includes annular resilient spring member 22 similar to that discussed on connection with the previous embodiments. As in the previously described embodiments, annulus 22 is coupled to elongate member 96 at a first location 100 and coupled to elongate member 101 at a second location substantially diametrically opposing the first location. Arcuate spring members 92 are assembled adjacent location 104 with nylon hinge 72 in the same manner as described in connecting with device 70. Segments 92 are fastened adjacent their ends 94 by the use of a sleeve or adaptor 112 that slips over ends 94 and end 98 of member 96 before handle 110 is threaded on the outer end of member 96.

Figure 12:
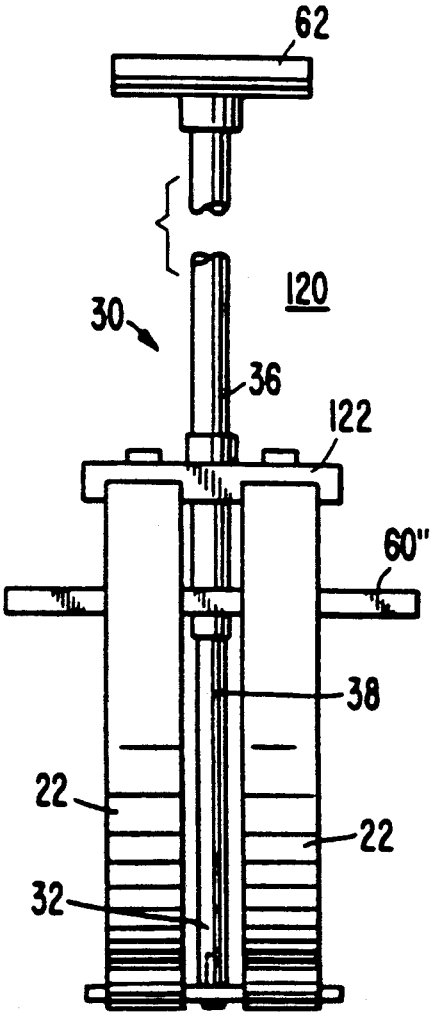
FIG. 12 is a front elevational view of an exercise device in accordance with a fourth embodiment of the present invention.
Figure 13:
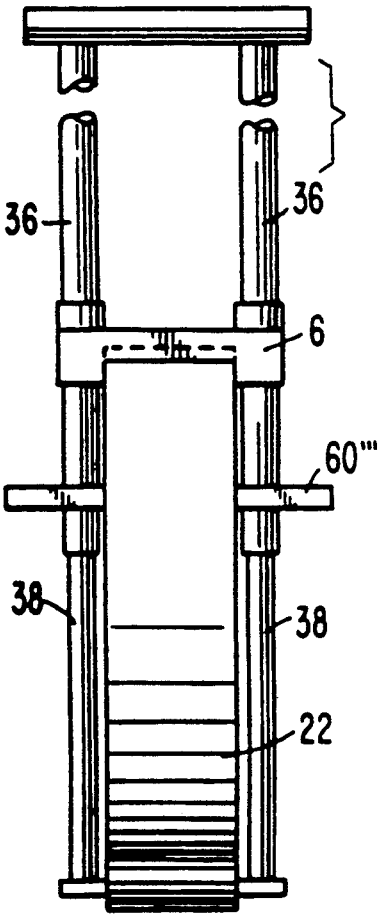
FIG. 13 is a front elevational view of an exercise device in accordance with a fifth embodiment of the present invention.
Figure 14:
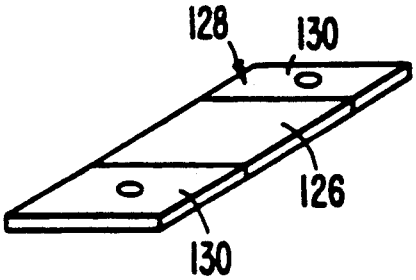
FIG. 14 is a view in perspective of the fastener for the bow springs of FIGS. 10 and 11.

FIGS. 12 and 13 illustrate fourth and fifth embodiments of the present invention of an exercise device for bouncing a user and the device from a utility surface. In accordance with the embodiment of FIG. 12, a device generally referred to at 120, includes a pair of spaced axially aligned annular resilient spring members 22, each having a peripheral annulus of the same predetermined radial thickness and an axially extending width. Fastening means 122 (see FIG. 14) in the form of a bar having spaced channels 124 and 124' engaging first peripheral locations of the spaced spring members 22, and a hard rubber rectangular plate 126 having a length corresponding to the total width dimension of the spaced annular member 22 laminated on a flexible rubber rectangular piece 128 having end flaps 130 that are secured to inner surface 46 of each member 22 for securing the members in axial alignment. A substantially rigid elongated assembly 30 that includes a pipe 36 is coupled to fastening means 122 between the spaced annular spring members 22 adjacent the first location and extends longitudinally along a line corresponding to the diameter of each of the annular spring members, said elongate member 36 has an outer end portion 34 terminating exterior the annulus of each spring member and an inner end portion terminating central of the annulus for supporting a foot support 60'' in the same manner as in the previously described embodiments. The invention may include a second substantially rigid elongated member 38 having an inner end portion telescopically mounted to the inner end portion of elongated member 36 for sliding relative member 36 longitudinally and having an outer end 32 portion fixedly attached to the fastening means adjacent the second location for maintaining substantial symmetry of flexure of each annulus upon relative sliding motion of the elongated members in response to a compressive and recovery force adjacent the first location of the annular members 22. A handle 62 having a grasping portion 66 is fastened to member 36 as previously described.

Referring to FIG. 13, exercise device 140, is similar to the previously described embodiments, except that it has a pair of telescopically connected assemblies straddling opposite sides of annular member 22', which may have a greater width than annular member 22.

Referring to the embodiments of FIG. 16 and FIG. 17 wherein the exercise device of the present invention is further modified to provide user adjustable ranges of stored energy, the embodiments of FIG. 16 and FIG. 17 are similar in construction to the embodiment of FIG. 1, for example; and further comprise the weight adjusting means for controlling the energy ranges in a progressive and a reserved manner. As embodied herein and referring to FIG. 16, hoop 22 has attached to the inner surface thereof a plurality of resilient segments 140, 141 and 142, which are aligned and stacked in the same plane as hoop 22 and disposed in physical engagement throughout their length to the inner surface of hoop 22 and to each other.

Figure 43:
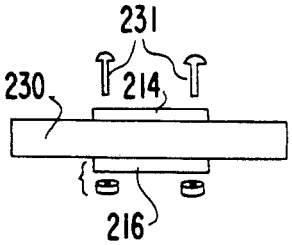
FIG. 43 illustrates a birds eye view of a hand grip for the device of FIG. 35 and 36.
Figure 44:
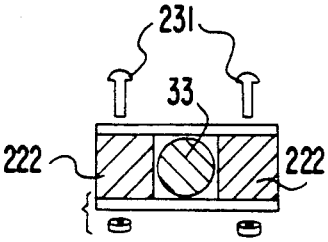
FIG. 44 is a sectional view taken at line 44—44 of FIG. 37 showing the assembly of the elongate member.

In accordance with the invention, fastening means are provided for selectively positioning the weight adjusting means a plurality of different positions in the inner surface of the hoop 22. (See FIG. 43(*a*)–(*i*) hereafter described). As embodied herein, a bracket 145 embraces stacked hoops such as 141, 142 and hoop 22; As shown in FIG. 19, a threaded bolt 146 and nut 148, for example, are provided to draw opposite ends of bracket 145 together to secure the spring segments into engagement with inner surface of hoop 22 at the desired angular position. Similarly, hoop segments 140, 141, and 142' are disposed in engagement with hoop 22 opposite the stacked segments 140 through 142. A bracket 145 selectively positions the latter referred to hoop segments in the same manner as the previously described hoop segments. In the embodiment of FIG. 16, it should be noted that each of the stacked hoop segments are in physical engagement with each other throughout their length and may be removably attached by more than a single bracket 145.

It is understood, that more or fewer than three segments, such as 140–142 for example, may be used, and with fastening means 145, the user is able to adjust a weight adjusting means to provide the desired compression and rebound to suit a personal preference. This is accomplished, by selecting the quantity of arcuate springs used; by selecting the stacked sequence of the lengths of the spring segments; and by selecting the angular location of the spring segments on hoop 22.

In accordance with the invention, weight adjusting means are provided that progressively store reserve energy as the annulus is compressed. As embodied herein and referring to FIG. 17, arcuate segments 150, 151, and 152 are stacked with a point of engagement approximately midway between opposite ends thereof, and are fastened by fastener 145. As illustrated, each one of the segments 150, 151, and 152 have a radius that is smaller than the adjacent segment and the ends of the segments are spaced from one another when the exercise device is in a non-compressed condition. In this embodiment, as the hoop 22 becomes compressed each one of arcuate segments, such as 151 through 152 are progressively depressed. Opposite the segments 150, 151, 152 are similarly fastened and configured segments 150', 151', and 152' in the embodiment of FIG. 17, where each arcuate segment has a radius which is significantly less than the annulus, with each segment being less than the preceding segment. Attachment is made at a central point, and the energy of the spring segments 150 to 152 and 150' to 152' is in reserve, and used as the hoop 22 becomes more and more compressed. The reserved stored energy is released as the loading of the annular spring is released. Thus, the annular spring means engages the first spring segment such as 152 and 152'; then the first spring segment 152, 152' makes contact with the second string segment 151, 151'; and finally, with the flexure of compression of hoop 22, 151, 151', make contact with segment 150, 150' respectively.

Although the hoop 22 in the embodiments of FIGS. 16 and 17 may be made of the same material as the arcuate spring segments, it is contemplated that for certain types of use or because of other considerations, it may be desirable to make hoop 22 of a flexible, but not necessarily an energy producing material, such as plastic, reinforced rubber, or heavy duty canvas, for example. Thus, hoop 22 would serve as a housing for user adjustable springs 140 through 142, and 150 through 152. Also, such a housing containing the arcuate segments could be composed of an energy producing material, such as spring steel or other resilient material, which derives in most part the energy source from the user adjustable arcuate segments.

Figure 23:
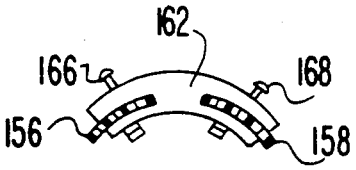
FIG. 23 is a fragmentary sectional view illustrating the manner in which the arcuate segments of FIG. 21 are connected.

In accordance with another embodiment of the present invention, the annular spring means is comprised of arcuate spring segments that are connected at opposite ends to form a resilient annulus. As herein embodied, and referring to FIG. 21, annular spring 154 is made up of an arcuate spring segment 156, and an arcuate spring segment 158. Each of the spring segments extend through an arc that is slightly less than 180°, such that ends of segments 156 and 158 are disposed opposite each other. Their corresponding opposite ends define a gap 160 and a gap 162 which are substantially diametrically opposed. Segments 156 and 158 are resiliently connected at opposite ends by a tubular member 162 (FIG. 22) that has a bore 164 with a diameter positioned to snugly receive opposite ends of arcuate spring segments 156 and 158. Member 162 is preferably a short piece of heavy duty hose that has the consistency and strength of reinforced nylon. The ends of segments 156 and 158 are inserted and fastened in bore 164 preferably by threaded nuts and bolts 166 and 168, respectively (see FIG. 23). The embodiment of FIG. 21 has certain advantages, in that the elongate member 33, 36 are able to be attached to the annulus by inserting them through an opening such as 170 in the tubular connecting member 162. Also, an arrangement such as shown in FIG. 21 can be packaged in a relatively small container and easily assembled by the purchaser.

In accordance with another embodiment of the invention, the annular spring means comprises a hoop that encloses an arcuate segment of slightly less than 360°. Referring to FIG. 25, and as herein embodied, annular spring means 172 is comprised of a unitary arcuate member 174 having opposing ends 176 and 178 that define a gap 180. In the embodiment of FIG. 25, annular spring means 172 is completed by connecting ends 176 and 178 together by a pair of heavy duty flexible columnar straps 182 (See FIGS. 27, 28, 29). Straps 182 may be fastened adjacent 176 and 178 of hoop 172 by threaded bolts 184. An insert 186 is inserted between straps 182 to substantially fill gap 180. It is also contemplated that a heavy duty hose connector such as 162, may be used in place of strap 182. Elongate member 36 is fastened to annular string means 172 by inserting it through orifices 188 and 190 of straps 182 and 186. Also, the annular spring means may comprise a hoop that encloses an arc greater than 360°. In this situation, ends 176 and 178 of spring 174 overlap, with member 36 being inserted through suitable aligned openings in the overlapping ends. Straps 182 and 186 are preferably made of a heavy duty polymer. Insert 186 can also be used for attaching and supporting the end of member 33 to hoop 174 where hoop 174 strikes the utility surface.

Figure 22:
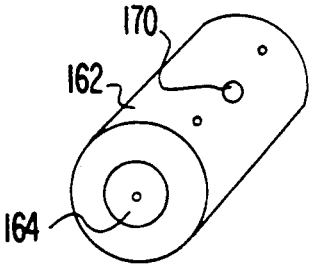
FIG. 22 is a perspective view of a component for connecting the arcuate segments of FIG. 21 to form the annular spring.
Figure 21:
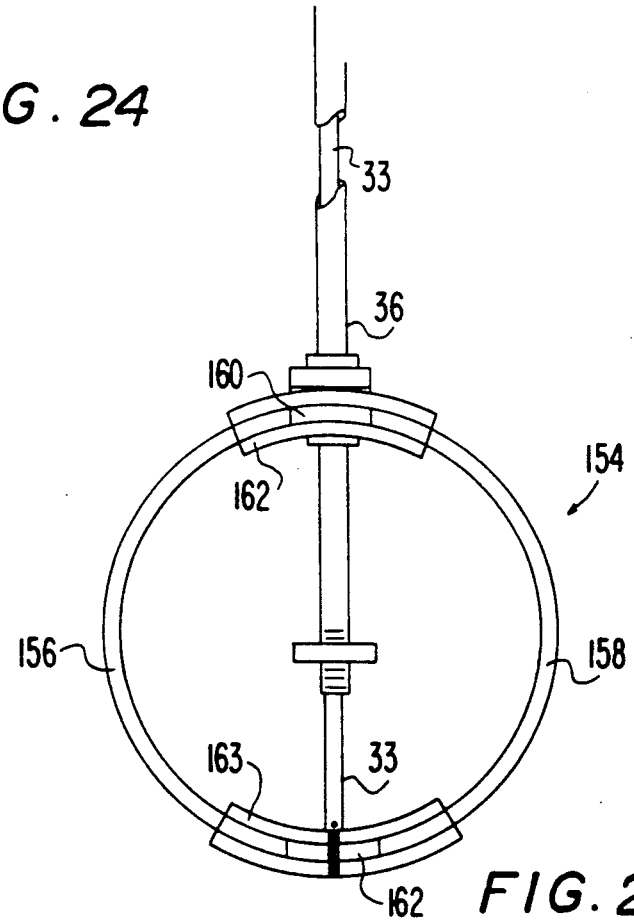
FIG. 21 is a front elevational view of an exercise device in accordance with a ninth embodiment of the present invention.
Figure 38:
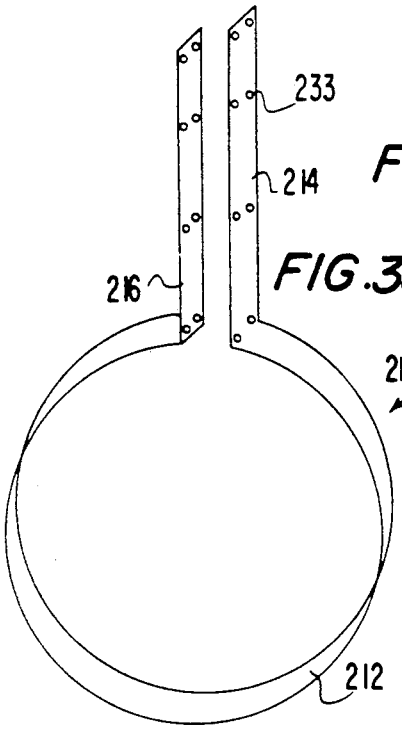
FIG. 38 is a view in perspective of the one piece housing for supporting the arcuate segments in the embodiment of FIG. 35 and FIG. 36.

Referring to the embodiment of FIG. 30, annular spring means 154 is similar to the embodiment of FIG. 21, except that elongate telescoping means 192 and 194 terminate at opposite ends within the periphery of the spring means; and is fastened at opposite ends to connecting members 196 (See FIG. 34) which is similar to connecting member 163 of FIG. 22, except that it does not include a bore for inserting stabilizing bar 192 and 194 therethrough. Instead, a U-shaped strap 198 as shown in FIG. 32 is used to fasten elongate member 192 at one end to connecting member 196. The strap 198 is slipped over the member 197; and is secured by threaded nuts and bolts 199 to member 192. Similarly, a strap 198 embraces member 196 at the opposite end of annulus 154, where the annular spring means strikes the utility surface.

It is contemplated that in the embodiment of FIG. 30, a user may stand on foot support 60 and grasp connecting 196 which would serve as a handle. However, if the user wishes to use a separate handle, a removable handle portion may be attached to one of the connecting members 196. Referring to FIG. 31, handle portion 200 may be made of any rugged material such as plastic, or metal. Member 200 includes a slot 202 having a width sufficient to slidably receive member 196 and stabilizing bar 192. Handle member 200 is fastened to bar 192 by threaded nuts and bolts 204. Member 196 may be slightly longer than connecting member 162 of the embodiment of FIG. 21 in there is a greater number of threaded nuts and bolts such as 206 used to fasten member 196 to opposite ends of arcuate segments 156 and 158.

Figure 24:
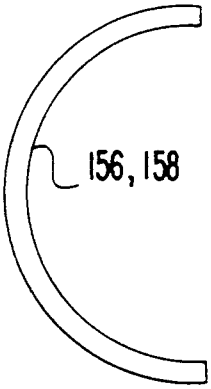
FIG. 24 illustrates an individual arcuate segment used in the embodiment shown in FIG. 21.
Figure 39:
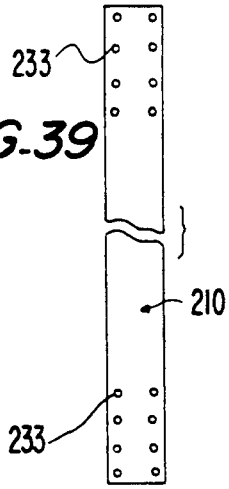
FIG. 39 is an elevational view of a member from which the housing of FIG. 38 can be made.
Figure 40:
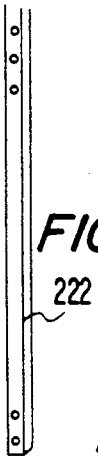
FIG. 40 is a perspective view of a bar used in fabricating the elongate portion of the embodiments of FIGS. 35 and 36.
Figure 41:
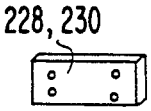
FIG. 41 is a member from which foot supports and a handle may be made for the device of FIGS. 35 and 36.
Figure 42:
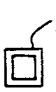
FIG. 42 is a sectional view of an alternate embodiment of the bar of FIG. 40.
Figure 35:
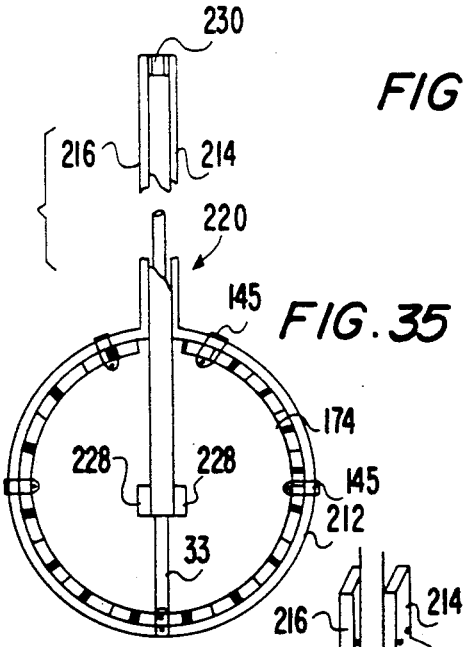
FIG. 35 is a front elevational view of a twelfth embodiment of the present invention.
Figure 37:
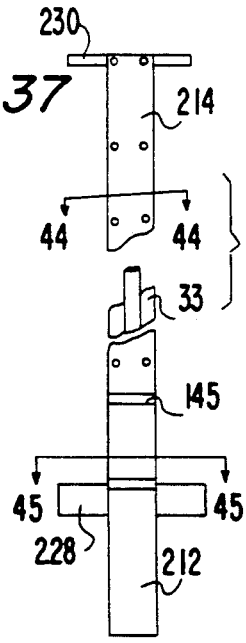
FIG. 37 is an elevational view of the embodiments of FIG. 35 and FIG. 36.
Figure 45:
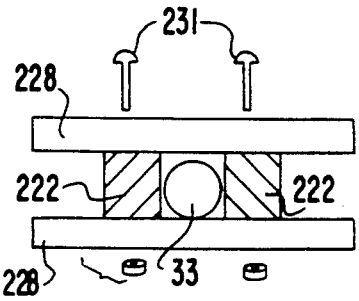
FIG. 45 is a sectional view taken at line 45—45 and looking in the direction of the arrows illustrating the footrest assembly for the embodiments of FIGS. 35 and 36.
Figure 36:
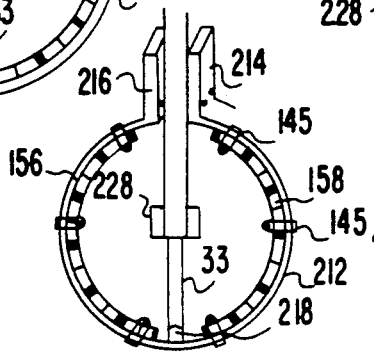
FIG. 36 is a fragmentary front elevational view illustrating a modification of the embodiment of FIG. 35.

Referring to the embodiments of FIG. 35 and 36, the annular resilient spring means includes a unitary housing 210, that is preferably made of a pliable polymer having a strength similar to that of nylon. Housing 210, which is preferably made of one strip such as shown in FIG. 39, may be bent to form a circular hoop portion 212 with opposite ends that oppose each other and extend radially outwardly, and which are referred to as flanges 214 and 216 respectively. Although, the housing 210 may have spring energy similar to the hoops and spring segments described in connection with the previous embodiments, it is contemplated that the portion 212 of the member is included merely as a housing for the resilient spring means of the device. In this connection, if desired, it may even be metal or other material adding strength to the remainder of the device similar to FIGS. 16 and 17. In the embodiment of FIG. 35, an arcuate spring segment such as 174 (see FIG. 26) is fastened to the inner surface of portion 212 of the housing connecting members such as 145 (see FIG. 19) spaced at various angular positions about the periphery of portion 212. Referring to FIG. 36, arcuate segments such as 156 and 158 (see FIG. 24) are fastened by members 145 to opposite sides of housing portion 212, and are disposed to provide a gap diametrically opposed to the radially extending flange portions 214 and 216. A circular rod such as 33 is fastened to housing 212 by a threaded bolt such as 218. A stabilizing bar assembly 220 is constructed by fastening a pair of spaced rigid rectangular bar portions 222 (FIG. 40) fastened between flange portions 214 and 216 to form a hollow frame work, for receiving rod portion 33 telescopically. At one end of the rectangular hollow assembly 220 is a pair of foot supports 228 (see FIG. 45). At the opposite end of hollow assembly 220 is a handle 230 (see FIG. 43). Suitable threaded nuts and bolts such as 231 fasten bars 222, handle 230, and foot supports 228 to radially extending flanges 214 and 216 via holes 233 to complete the exercise device. Foot support 228 and handle 230 may be made from the member shown in FIG. 41. The individual parts of the assembly 220 may be made of plastic or light metal such as aluminum.

Referring to FIG. 46, several arrangements of the weight adjusting means for the various preferred embodiments are illustrated schematically by way of example. For example, the hoop of 46(*a*) involves a unitary annular hoop with a plurality of arcuate segments in equal strength on opposite sides of elongate member 36 that are stacked, and are in engagement with each other throughout their length. Each one of the arcuate segments is arranged so that each segment is shorter than the adjoining one and in sequence. Referring to FIG. 46(*b*) the sequence of the stacked segment is different so that the longer of the plurality of segments is sandwiched between the medium and shorter segment. This sequence gives a different bounce than the sequence of 46(*a*). In 46(*c*) the sequence of the arcuate weight adjusting segments is the same as 46(*a*) except, they are positioned angularly off center so that the opposing weight adjusting stacks are located substantially in the northeast and southwest quadrants of the annulus respectively. This arrangement provides a stiffer bounce than the arrangement that is equidistant from opposite sides of the elongate member such as shown in FIG. 46(*a*) or 46(*b*). Referring to FIG. 46(*d*), the arcuate weight adjusting segment is fastened to the inner surface of the annular hoop on one side of the elongate stabilizing bar only. This arrangement loads only one side, so that a flexing of the annulus assists horizontal or in other words cross country motion of the device. FIG. 46(*e*) shows an arrangement where the weight adjusting segments are fastened to the bottom portion adjacent where spring means strikes the utility surface; FIG. 46(*f*) is similar to the arrangement of FIG. 46(*a*) except that the annular spring means is comprised of a pair of arcuate segments that are longer than the weight adjusting segments for forming the annulus. It should be noted that in the arrangement of FIG. 46(*e*), the downward force of the annular spring means opens the arc of the spring segments instead of compressing them. FIG. 46(*g*) illustrates an elliptical hoop 236 having weight adjusting segments as opposite ends of the major axis. FIG. 46(*h*) is similar to the embodiment of FIG. 17 except it is illustrated in an elliptical hoop.

Thus, it can be seen that with the benefit of the present invention, an exercise device is provided that is user adjustable in a multitude of ways for varying the spring action of the device. The characteristics of the device can be varied such that the bounce is either stiff or soft or it is stiffer on one side than the other, for creating a cross country motion during the operation of the device. The user can adjust the device for soft compression and stiff rebound, or stiff compression, and soft rebound. Of course, as previously mentioned, the device can be used for various individual weights of users depending upon the number of arcuate segments that are used.

In operation, the devices are positioned upright as viewed in the drawings, and the user stands on the foot support and grasps the handle. With the handle securely grasped the user jumps slightly in the air to increase the downward force on the supports. This deforms the annulus and segments and weight adjusters if so equipped. The annulus assumes an oval shape at the bottom of the users descent. The resiliency of the annular member cause it to assume its normal configuration propelling the device and the user off the ground or utility surface. With respect to the arcuate segments members, the jumping action causes the radius of the arc to decrease at the depth of descent and to spring back for propelling the user upwardly.

It will be apparent to those skilled in the art that various modifications and variations can be made in the exercise device of the present invention and in the manner in which the various parts are attached and assembled. As an example, the annular member 22, weight adjuster 74, and arcuate segment 92, all may be tubular in cross section. Foot supports 60 may also be tubular. Although, the invention is illustrated as comprising a circular spring member, it is contemplated that it could be elliptical or irregular in configuration. Thus, it is intended that the present invention cover the modifications and variations of this invention provided they come within the scope of the appended claims and their equivalents.

What I claim is:

1. An exercise device for bouncing a user carried by the device from a utility surface, comprising:

resilient spring means having a peripheral annulus for bouncing a user off the utility surface upon the flexing of the annulus in response to a jumping motion of the user, the annulus having an outer surface for facing the utility surface and an opposite inner surface, the spring means including weight adjustable means attached to at least one of the inner and outer surfaces of the annulus for varying the flexing motion of the spring means in response to a predetermined jumping force stabilizing means connected to the annulus for maintaining substantial symmetry of flexure in response to a compressive and recovery force, a foot support mounted to either one of said annulus and stabilizing means for supporting the weight of a user; a handle means mounted spaced from the foot support for grasping by user standing on the foot support and means for removably mounting the weight adjusting means to the annulus at any one of a selected plurality of angular locations about the periphery of the annulus.

2. The device of claim 1 wherein the weight adjusting means comprises at least one arcuate spring segment.

3. The device of claim 1 wherein the weight adjusting means comprises a pair of opposing arcuate spring segments.

4. The device of claim 2 wherein the at least one arcuate spring segment has a radius less than the annulus and the mounting means engages the arcuate spring segment intermediate the opposite ends of the segment.

5. The device of claim 1 wherein the weight adjusting means comprises a plurality of stacked spring segments.

6. The device of claim 5 wherein each of the plurality of stacked arcuate spring segments has a radius less than the annulus and each other, and the mounting means fixes the stacked segments to the annulus intermediate the ends thereof.

7. The device of claim 1 wherein the spring means is a unitary annular resilient non-metallic member.

8. The device of claim 7 wherein the weight adjusting means includes at least one arcuate segment disposed in engagement with the annulus at a first selected angular location at one side of the location wherein the annulus spring means strikes the utility surface.

9. The device of claim 8 wherein the weight adjusting means includes at least one second arcuate spring segment at a second selected angular location at a side of the location where the annulus strikes the utility surface.

10. An exercise device for bouncing a user carried by the device from a utility surface, comprising:

spring means including a peripheral annulus of a selected diameter, radial thickness, and axially extending width for bouncing a user within a predetermined weight range off the utility surface engaged by the annulus upon the flexing of the annulus in response to a jumping motion of the user, the spring means including at least one arcuate resilient member;

elongate means having first and second end portions defining a longitudinal axis extending therebetween, the elongate means being fixedly mounted adjacent first and second end portions thereof to the spring means at respective substantially diametrically opposed first and second locations, the first and second end portions being compressible and expandable toward and away from one another respectively along the defined longitudinal axis, the elongate means maintaining substantial symmetry of flexure of the annulus in response to a compressive and recovery force in the direction of the defined longitudinal axis;

a foot support mounted on either one of said spring means and said elongate means for supporting the weight of a user at times when the spring means is upright and engaging the utility surface at the first location, said support being mounted to move with the spring means adjacent the second location and relative to the spring means adjacent the first location; and a handle means mounted spaced from the foot support for grasping by a user standing on the foot support.

11. The exercise device of claim 10 wherein the at least one arcuate resilient member has opposing ends spaced from one another to define a gap at one of the first and second diametrically opposed locations of the annulus.

12. The device of claim 11 wherein the portion of the annulus at the second location is a connecting member securing the opposed ends of the arcuate member spaced from one another, and the elongate means is mounted to the connecting member between the opposing ends of the arcuate resilient member.

13. The device of claim 11, further comprising weight adjusting means for varying the compression and rebound of the spring means, and means for removably attaching the weight adjusting means to the annulus.

14. The device of claim 13 wherein the weight adjusting means comprises at least one arcuate spring segment fixed to the inner surface of the annulus.

15. The device of claim 13 wherein the weight adjusting means comprises a pair of opposing arcuate spring segments fixed to the surface of the annulus.

16. The device of claim 14 wherein the at least one arcuate spring segment has a radius less than the annulus and the mounting means engages the arcuate spring segment intermediate the opposite ends of the segment.

17. The device of claim 13 wherein the weight adjusting means comprises a plurality of stacked spring segments removably mounted at a selected position to the annulus.

18. The device of claim 13 wherein each of the plurality of stacked arcuate spring segments has a radius less than the annulus and each other, and the mounting means fixes the stacked segments to the annulus intermediate the ends of the stacked segments.

19. An exercise device for bouncing a user and the device from a utility surface, comprising:

an annular spring means including a pair of oppositely disposed resilient arcuate spring segments each terminating at first and second opposite end portions and lying in substantially the same plane;

first connecting means fixing the first end portion of each arcuate spring segment to one another;

second connecting means fixing the second end portion of each arcuate spring segment to one another, said first and second connecting means being substantially diametrically opposed, said pair of spring segments and the first and second connecting means defining an annulus;

a first substantially rigid elongate member having inner and outer end portions, said member being fixedly attached adjacent the outer end portion thereof to the first connecting means and extending longitudinally along a line substantially corresponding to the diameter of the annulus;

a second substantially rigid elongate member having an inner end portion telescopically mounted to the inner end portion of the first elongate member for sliding relative the first member longitudinally and having an outer end portion fixedly mounted to the second connecting means, the relative sliding motion of the first and second elongated members being operative to flex the opposing spring segments for storing and releasing energy; and a foot support mounted to one of either the first elongate member and the annulus for supporting the weight of a user.

20. The device of claim 19 wherein the portion of the annulus at the second location is a connecting member securing the opposed end of the arcuate member spaced from one another, and the elongate means is mounted to the connecting member between the opposing ends of the arcuate resilient member.

21. The device of claim 19, further comprising weight adjusting means for varying the compression and rebound of the annular spring means, and means for removably attaching the weight adjusting means to the annulus.

22. The device of claim 21 wherein the weight adjusting means comprises at least one arcuate spring segment fixed to the inner surface of the annulus.

23. The device of claim 21 wherein the weight adjusting means comprises a pair of opposing arcuate spring segments fixed to the inner surface of the annulus.

24. The device of claim 21, wherein the at least one arcuate spring segment has a radius less than the annulus and the mounting means engages the arcuate spring segment intermediate the opposite ends of the segment.

25. The device of claim 21 wherein the weight adjusting means comprises a plurality of stacked spring segments removably mounted at a selected position to the inner surface of the annulus.

26. The device of claim 21 wherein each of the plurality of stacked arcuate spring segments has a radius less than the annulus and each other, the mounting means fixes the stacked segments to the annulus intermediate the ends thereof.

27. The device of claim 10, wherein the at least one arcuate resilient member extends through an arc of less than 360°.

28. The device of claim 10, wherein the at least one arcuate resilient member is spring steel.

* * * * *